United States Patent [19]

Moss

[11] 4,285,682

[45] * Aug. 25, 1981

[54] CARTON ERECTING MACHINE

[75] Inventor: Edward L. Moss, Orlando, Fla.

[73] Assignee: Moss Machinery Manufacturers, Inc., Orlando, Fla.

[ * ] Notice: The portion of the term of this patent subsequent to Jun. 30, 1998, has been disclaimed.

[21] Appl. No.: 33,210

[22] Filed: Apr. 25, 1979

[51] Int. Cl.[3] ..... B31B 1/62; B31B 1/80; B31B 3/02

[52] U.S. Cl. ..... 493/316; 493/181; 493/183

[58] Field of Search ..... 93/49 R, 49 M, 49 AC, 93/94 PS, 39 R, 39.1 R, 39.1 P

[56] References Cited

U.S. PATENT DOCUMENTS

| | | | |
|---|---|---|---|
| 3,580,144 | 5/1971 | Renard | 93/94 PS X |
| 3,635,129 | 1/1972 | Cobelo | 93/49 AC X |
| 3,648,574 | 3/1972 | Luke | 93/49 AC |

*Primary Examiner*—Robert D. Baldwin
*Attorney, Agent, or Firm*—Stein & Frijouf

[57] ABSTRACT

An apparatus is disclosed for erecting folded cartons comprising a first and a second carton track established in a substantially L-shaped configuration. A carton magazine is mounted at one end of the first track whereas a carton erector is secured relative to the junction of the first and second tracks. A flap folder is mounted along the second track for folding the flaps of the carton with a carton sealer being located at the terminal end of the second carton track. A first drive provides reciprocal movement along the first carton track for serially moving the cartons from the carton magazine to the carton erector. A second drive moves the carton along the second track from the carton erector to the carton sealer. The first drive may comprise an air cylinder controlled in accordance with the movement of the second drive. The second drive may comprise a reciprocal mechanical linkage for driving the cartons along the second track.

12 Claims, 12 Drawing Figures

CARTON ERECTING MACHINE

BACKGROUND OF THE INVENTION

1. Field of the Invention

This invention relates to containers, and more particularly to machines for assembling and erecting paper or cardboard cartons.

2. Description of the Prior Art

Various apparati have been developed in the art for aiding the packaging or containerization of manufactured items or the like. In many instances, manufacturing companies purchase cartons in the folded or unassembled condition. Generally, folded cartons are precut with four lateral sides and a top and/or a bottom composed of two major flaps and two minor flaps. The folded carton is shipped in the folded position wherein all lateral sides of the carton are substantially parallel to one another. Accordingly, the carton must first be erected such that two of the parallel sides are perpendicular to the remaining two parallel sides. Second, the two minor or smaller flaps are folded and adhesive is applied to either the minor or the major flaps. Third, the major or larger flaps are folded into contact with the minor flaps to form the top or the bottom of the carton. The major and minor flaps are then pressed against one another while the adhesive sets to complete the assembly of the folded carton.

The manual erection, folding and sealing of cartons is a time consuming and expensive operation. Accordingly the prior art has attempted to develop simple, inexpensive and reliable carton erecting machines which may be purchased by a manufacturer desiring to ship a product in cartons. In general, such a carton erecting machine is a non-productive capital investment to the manufacturer since the machine is not producing an end product. The machine is only used for assembling the folded cartons to ship the manufactured or end products therein. Although the use of a carton erecting machine does save valuable man-hours, the machine does not increase productions in terms of the number of manufactured units produced. Accordingly, it is understandable that a manufacturer is reluctant to invest a large sum for an automated carton erecting machine. In addition, it is extremely disturbing for the manufacturer to purchase a sophisticated carton erecting machine to find that the machine frequently requires service to maintain operation of the machine.

Various types of carton erecting machines have been used by the prior art. Among the more reliable machines were the L-shaped machines having a first and a second carton track. A carton magazine was located at one end of the first carton track whereas a carton erector was located at the intersection of the first and second carton tracks. The second carton track was used for folding the major and minor carton flaps and sealing the flaps together. Although the L-shaped machines of the prior art had the advantage of a positive carton stop at the intersection of the first and second carton tracks, the machine required a complex mechanical linkage for moving the carton along the first and second tracks. Some in the prior art have incorporated a reciprocal movement means for moving the cartons along one of the tracks which reciprocal movement was coupled through a clutch mechanism to move cartons along the other of the tracks. Unfortunately, the clutch mechanism had a limited life, making the entire machine unreliable and costly to operate and maintain. It is not surprising that these machines were not widely accepted in the art.

Therefor it is an object of this invention to provide an apparatus which overcomes the aforementioned inadequacies of the prior art devices and provides an improvement which is a significant contribution to the advancement of the packaging art.

Another object of this invention is to provide an apparatus for erecting folded cartons comprising first means for driving cartons along the first track which is synchronized with second means for driving cartons along the second track.

Another object of this invention is to provide an apparatus for erecting folded cartons wherein the first means includes an air cylinder drive means for generating a reciprocal movement to for a first track movement means to move cartons along the first track. The air cylinder drive means is synchronized with the reciprocal movement of the second track movement means.

Another object of this invention is to provide an apparatus for erecting folded cartons wherein the second means includes a first and a second rotatable sprocket spaced relative to one another with a chain interconnecting the first and second rotatable sprockets. A driving pin extends from the chain which pin is received between plural fingers for generating a reciprocal movement upon rotation of the sprockets.

Another object of this invention is to provide an apparatus for erecting folded cartons wherein a first carton track has a longitudinal length different than the longitudinal length of a second carton track. The first and second means are established for simultaneously moving cartons along the different longitudinal lengths of the first and second tracks.

Another object of this invention is to provide an apparatus for erecting folded cartons wherein the second driving means provides engagement with both the bottom and the top of the carton through the use of a C-shaped drive mechanism.

Another object of this invention is to provide an apparatus for erecting folded cartons having a carton erector and a minor flap tucker arm each of which is adjustably mounted relative to the machine by mounting plates. The adjustable mounted plates enable simplified and custom adjustment within the machine or interchange of components with other machines or similar nature.

Another object of this invention is to provide an apparatus for erecting folded cartons wherein the apparatus may be quickly repaired in the remote possibility of a malfunction.

Another object of this invention is to provide an apparatus for erecting folded cartons wherein the individual stages of this machine may be used as individual stages for similar erecting machines specifically designed for folding or erecting different type cartons.

Another object of this invention is to provide an apparatus for erecting folded cartons which has been greatly simplified over the prior art machines thereby increasing the reliability and reducing the manufacturing cost thereof.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention may be incorporated into an apparatus for erecting folded cartons having carton flaps. The apparatus comprises a first and a second carton track established in an L-shaped configuration. Each of the first and second tracks has a first and a second end. The second end of the first track is coincident with the first end of the second track forming the L-shaped configuration. A carton magazine means is positioned at the first end of the first track for holding a plurality of cartons. A first track movement means moves the folded cartons on the first track from the carton magazine to the second track. A carton erecting means is located at the junction of the first and second tracks for erecting the folded cartons. A second track movement means moves the erect cartons from the first end of the second track to the second end of the second track. Flap folding means fold the major and minor flaps of the carton during the movement of the carton along the second track. A sealer is located at the second end of the second track for sealing the flaps of the erected carton into a rigid structure. First means is provided for driving the first track movement means in a reciprocal movement to serially move the the plurality of cartons from the first end to the second end of the first track. Second means is provided for driving the second track movement means in a reciprocal movement to serially move the plurality of cartons along the second track.

In one embodiment, the first means may include a first and a second rotatable member such as a sprocket or a pulley spaced relative to one another. Flexible means such as a chain or belt interconnects the first and second rotatable members for movement therewith. The flexible means includes a driving portion or projection extending from the flexible means for defining the reciprocal movement upon rotation of the rotatable members. Plural parallel fingers receive the projection therebetween to generate the reciprocal movement from the movement of the projection.

In a specific example of the invention, the first carton track has a longitudinal length different from the longitudinal length of the second carton track. The first means comprises an air cylinder whereas the second means comprises a motor and appropriate drive mechanism. The first and second track movement means are synchronized for enabling simultaneous movement of cartons along the different longitudinal lengths of the first and second tracks.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
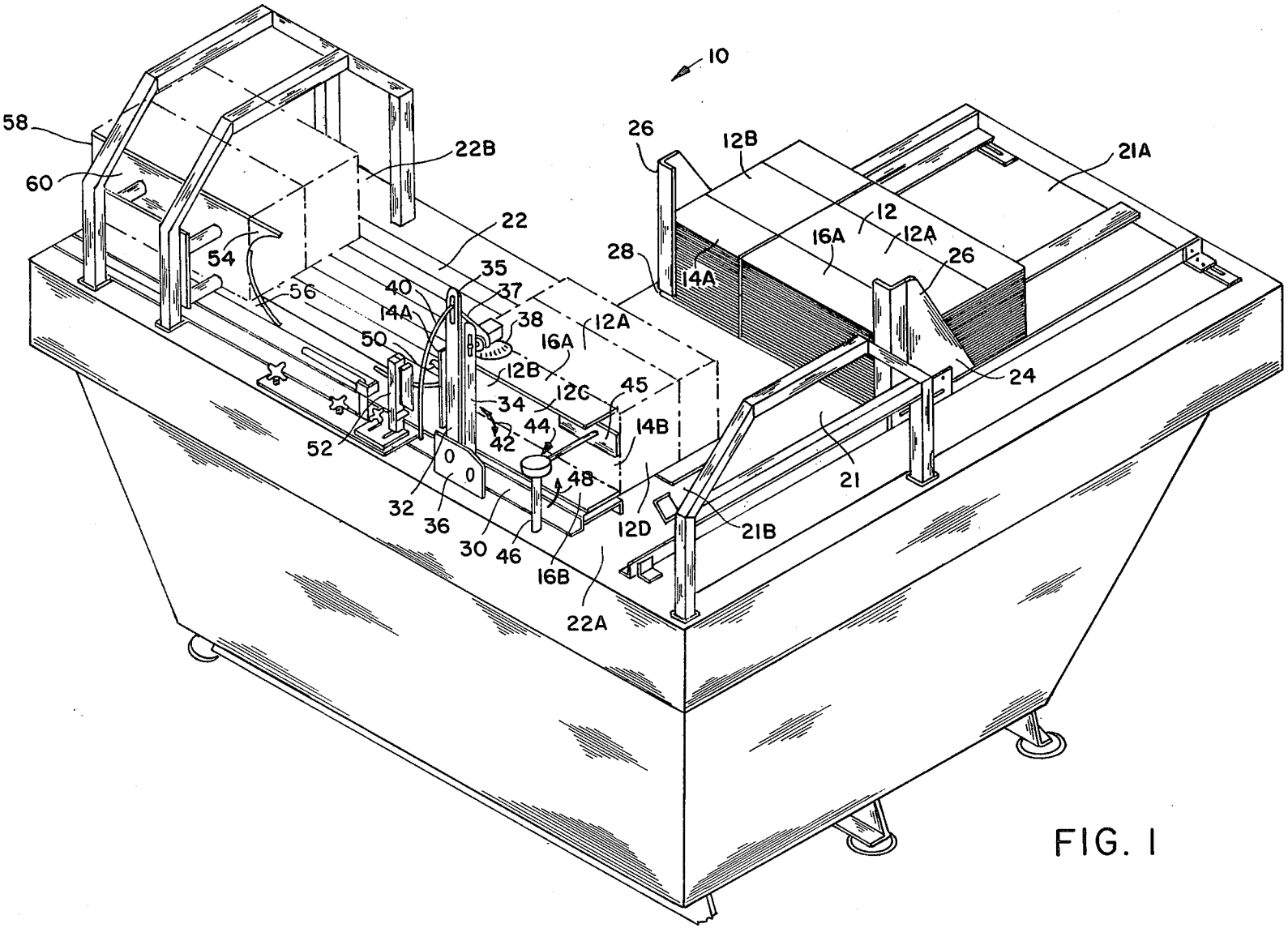
FIG. 1 is a perspective view showing the apparatus with some of the upper framing removed to clearly illustrate the movement of the cartons within the machine.

FIG. 1 is a perspective view of an apparatus 10 for erecting folded cartons 12. Each of the cartons comprises four lateral sides 12A–12D, two minor flaps 14A and 14B and two major flaps 16A and 16B. The carton 12 comprises additional major and minor flaps when the carton is a complete container rather than functioning merely as a top or a bottom member of a two-part container. The instant invention is equally compatible with both of the aforementioned variations.

The apparatus 10 comprises a first and a second carton track 21 and 22 established in a substantially L-shaped configuration. The first carton track 21 has a first end 21A and a second end 21B whereas the second track 22 comprises a first end 22A joining with the second end 21B of the first track and extending to a second end 22B. In this embodiment, the first track 21 has a shorter longitudinal length than the second track 22.

A carton magazine 24 is located in proximity to the first end 21A of the first carton track 21. The carton magazine 24 comprises plural upstanding corner guides 26 containing bottom slots 28 enabling only a single bottom carton to move along the first track 21 from the first end 21A to the second end 21B. The bottom carton of the stack shown in FIG. 1 is moved by first track movement means from the first end 21A to the second end 21B until the major and minor flaps 14A and 16A strike a stop 30. The first track movement means will be fully explained in FIGS. 4 and 5.

Figure 9:
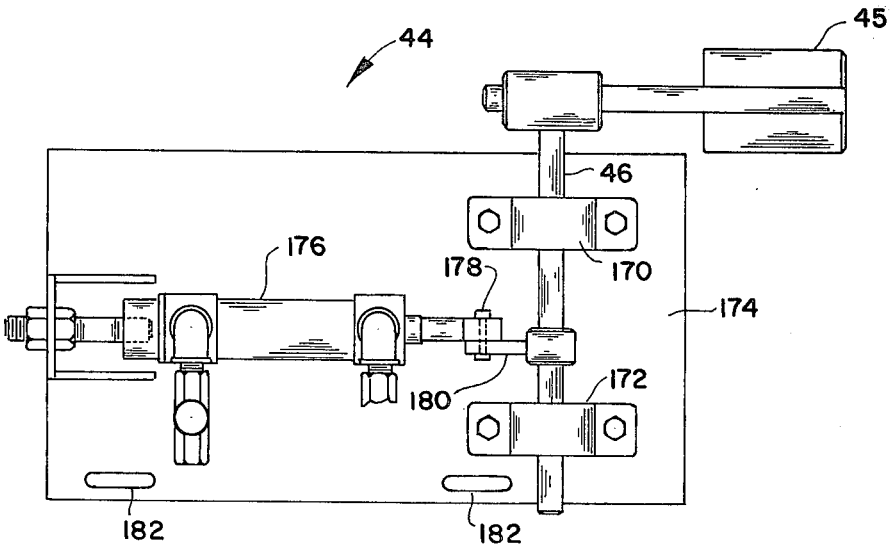
FIG. 9 is a side elevational view of a tucker arm utilized within the instant invention.
Figure 10:
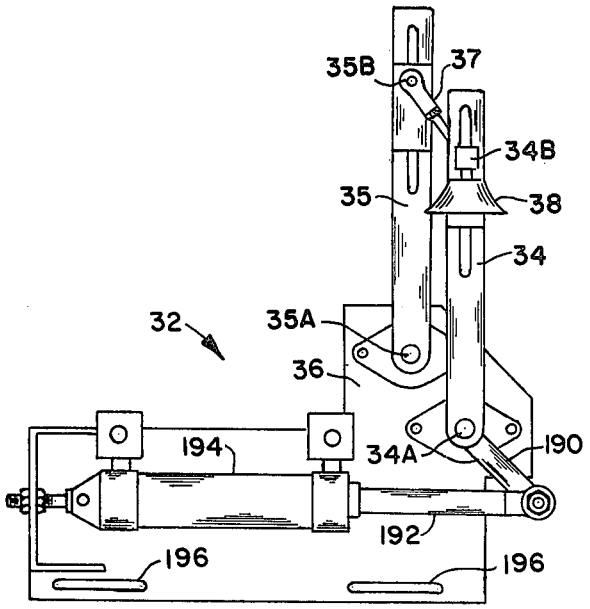
FIG. 10 is a side elevational view of a carton erector shown in the deactivated position.
Figure 11:
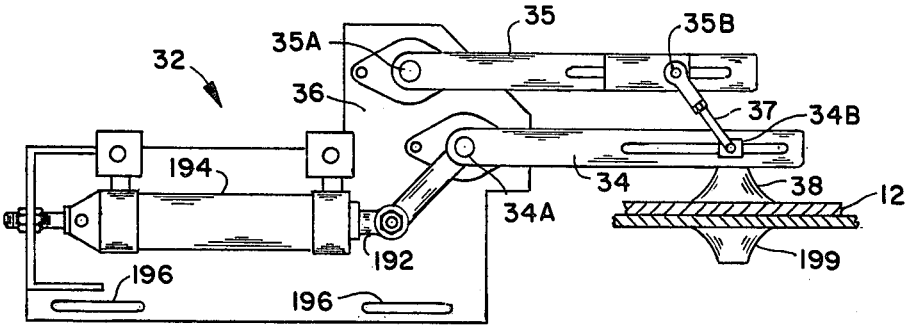
FIG. 11 is a side elevational view of a carton erector shown in the activated position.

A carton erecting means 32, shown more fully in FIGS. 10 and 11 is located at the intersection of the first and second carton tracks 21 and 22. The carton erecting means 32 comprises arms 34 and 35 pivotably mounted on a support 36 and having a vacuum cup 38 mounted on the terminal end of arm 34. A vacuum line 40 connects vacuum cup 38 to a vacuum source (not shown). The carton erecting means 32 erects the carton 12 by first rotating arm 34 downwardly in the direction shown by arrow 42 until the vacuum cup 38 contacts major flap 16A. Vacuum is applied through vacuum line 40 to grasp major flap 16A. Rotation of the arm 34 in an upward direction as shown by arrow 42 erects the carton 12 as shown in FIG. 1. A tucker arm 44 shown in greater detail in FIG. 9, comprises a shoe 45 pivotably mounted on shaft 46 to fold minor flap 14B upon rotation of shaft 46 in a direction shown by arrow 48. Upon folding the minor flap 14B, shaft 46 rotates ninety degrees from the position shown in FIG. 1 in a direction opposite to the direction indicated by arrow 48. The partially erected carton 12A is then moved along the second carton track 22 as will be hereinafter described.

Figure 12:
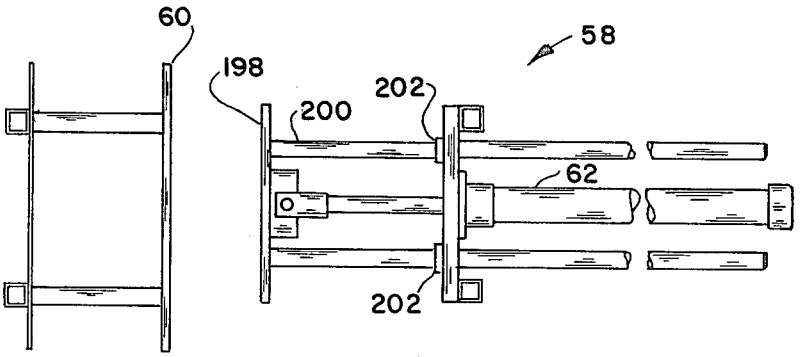
FIG. 12 is an elevational view of a ram stage of the apparatus.

A minor flap plow 50 folds minor flap 14A upon movement of the carton 12 along the second track 22. An adhesive station 52 comprises a compressed air adhesive spray gun activated by photoelectric or mechanical means for spraying an adhesive on the minor flaps 14A and 14B. Major plow surfaces 54 and 56 respectively fold major flaps 16A and 16B upon continued movement of the carton 12 along second track 22. A ram station 58 shown more clearly in FIG. 12, comprises a plate 60 and a hydraulic pneumatic or mechanical ram 62 to press the major flaps 16 into contact with the minor flaps 14 for sealing the erected carton 12 into a rigid structure. The completed carton 12 is forced off of the second end 22B of the second carton track 22 by the next subsequent carton moving through the assembly process.

Figure 2:
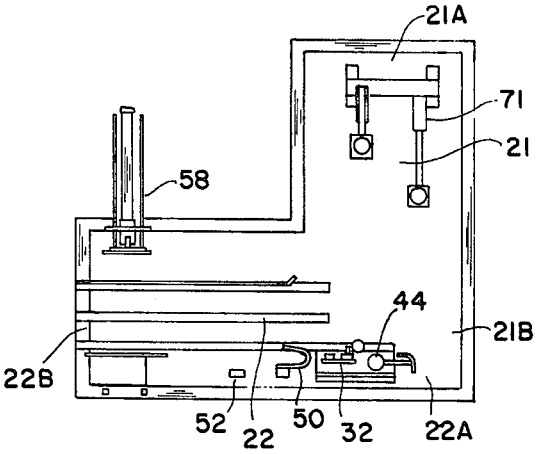
FIG. 2 is a simplified plan view of the apparatus.
Figure 3:
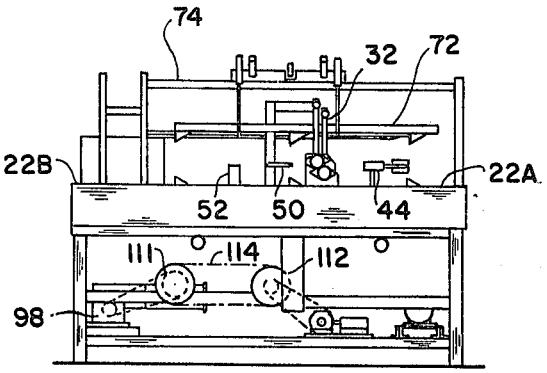
FIG. 3 is a simplified side elevational view of the apparatus.

FIGS. 2 and 3 illustrate top and side elevational views of the apparatus shown in FIG. 1 illustrating a first and second means 71 and 72 for moving the cartons along the first and second tracks 21 and 22. The first means 71 is shown more specifically in FIGS. 4 and 5 whereas the second means 72 is shown more specifically in FIGS. 6–8. A portion of the upper support member 74 is also illustrated in FIG. 3 which was deleted from the embodiment shown in FIG. 1.

Figure 4:
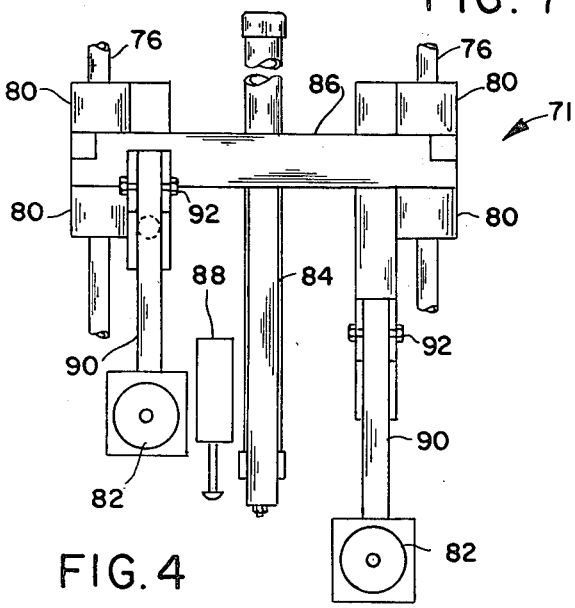
FIG. 4 is a top view of first track movement means for moving the carton along a first track.
Figure 5:
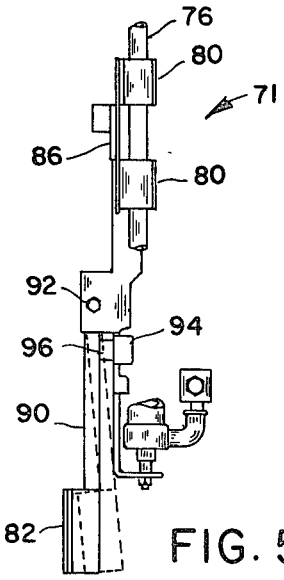
FIG. 5 is a side elevational view of FIG. 4.

FIGS. 4 and 5 illustrate top and side views of the first means 71 for moving the cartons along the first track 21. Plural rods 76 are secured relative to the machine frame 78 for providing a sliding engagement with blocks 80. An air cylinder 84 drives a cross member 86 for moving the blocks 80 on rods 76 to linearly displace vacuum pick up heads 82 along the first track 21. A shock absorber 88 eliminates any rapid motion of the heads 82 caused by the air cylinder 84.

Each of the vacuum pick up heads 82 is secured on an arm 90 pivotably mounted by a pivot 92 relative to the cross member 86. Plural lift cylinders 94 each having a piston 96 move the respective arms 90 into the full position shown in FIG. 5 to grasp the under side of a carton within the carton magazine 24. Air cylinder 84 then moves the carton to the second end 21B of the first track 21. Lift cylinders 90 are deactivated enabling arms 90 to move into the phantom position shown in FIG. 5 by action of gravity. Air cylinder 84 is then deactivated to move the vacuum pickup heads 82 to the first end 21A of the first track 21. Lift cylinders 94 may then be activated to grasp the next carton by vacuum heads 82.

Figure 6:
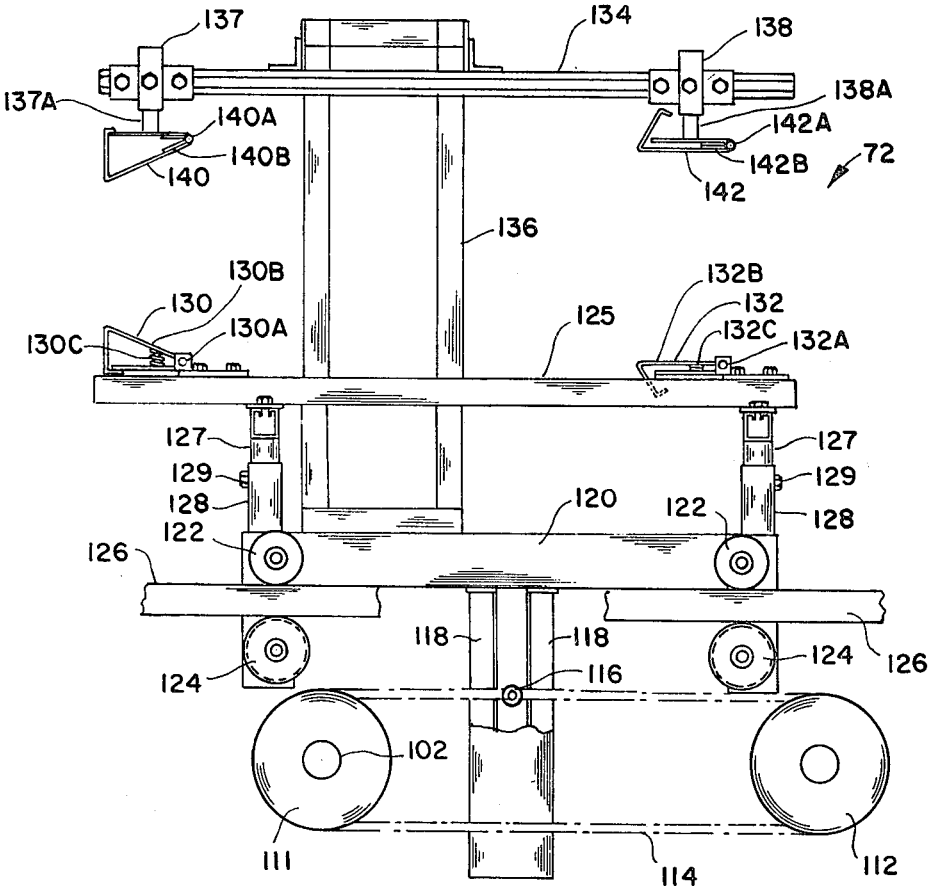
FIG. 6 is an enlarged side elevational view of a second track movement means.
Figure 7:
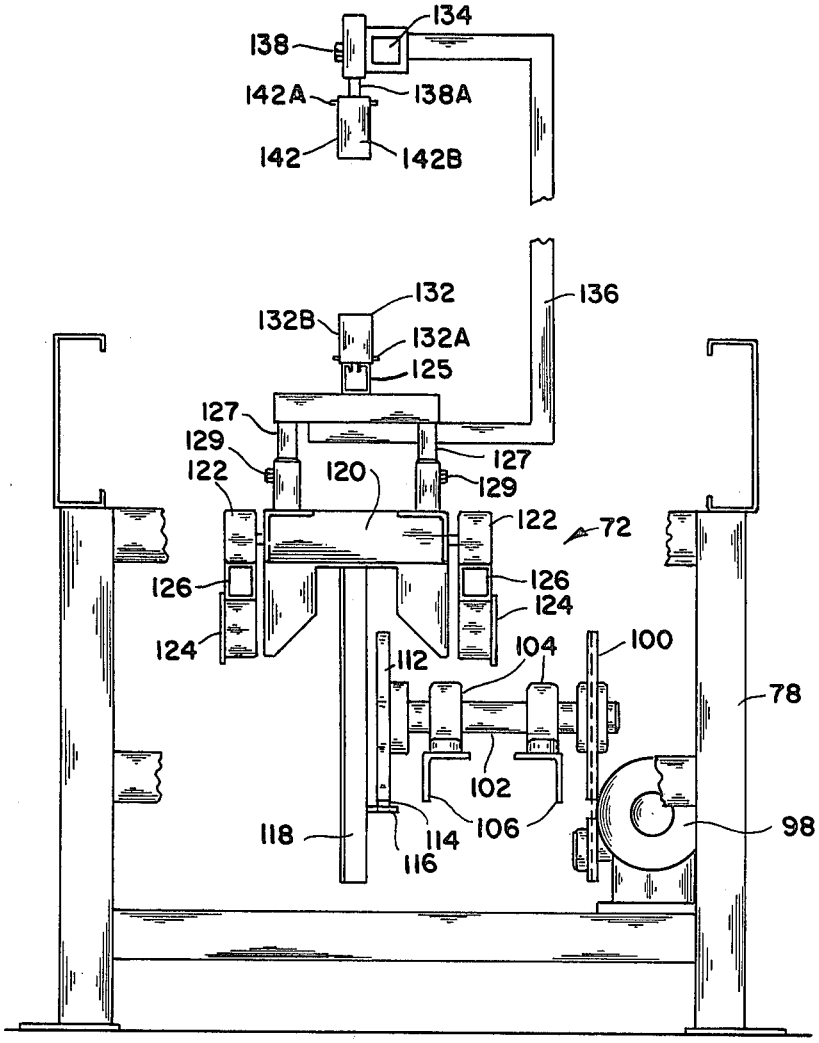
FIG. 7 is an end view of the second track movement means.
Figure 8:
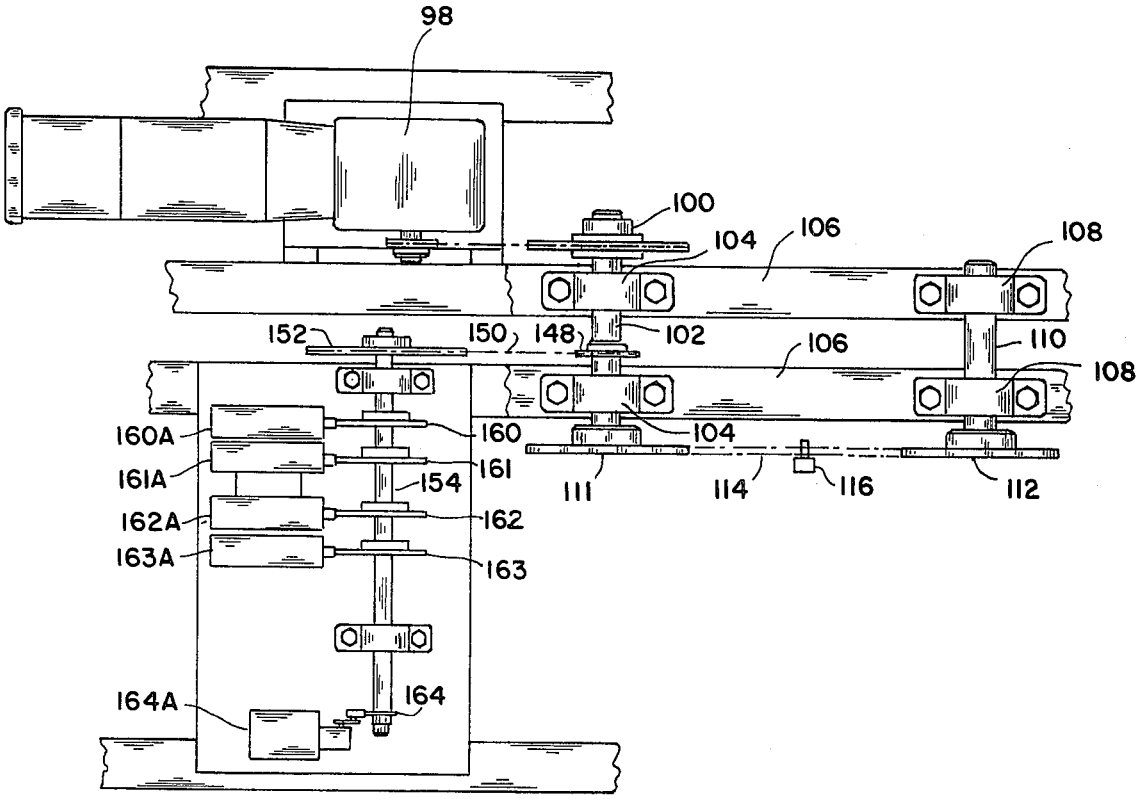
FIG. 8 is a plan view of a motor drive and control.

The second means 72 is more specifically shown in FIGS. 6, 7 and 8 and comprises a motor 98 driving a slip clutch 100 for rotating a shaft 102 journalled by bearings 104 secured to supports 106. A first and second rotatable member 111 and 112 shown as sprockets are interconnected by a chain 114 with a projection 116 extending from chain 114. Sprocket 112 is secured to shaft 110 joined by bearings 108. Although the rotatable members 111 and 112 have been disclosed as sprockets with a chain 114 connected therebetween, it should be appreciated that any type of rotatable member and any type of flexible means connected thereto is within the scope of this invention.

Plural parallel fingers 118 are secured to a slidable support frame 120 having upper rotatable wheels 122 and lower rotatable wheels 124 respectively contacting the upper and lower sides of a support beam 126. Rotation of the sprockets 111 and 112 causes a reciprocal movement of slidable support 120 relative to support means 126. It should be appreciated in FIG. 7 that plural support beams 126 are utilized in combination with with four upper wheels 122 and four lower wheels 124. A lower support guide 125 is adjustably mounted to the support frame 120 by telescopic sections 127, 128 and fasteners 129. The lower support guide 125 receives plural carton engaging means 130 and 132. An upper support guide 134 is suspended by a generally C-shaped vertical support 136 for positioning upper carton engaging means 140 and 142. The upper carton engaging means 140 and 142 are adjustably mounted by mounts 137 and 138 and telescoping sections 137A and 138A. It should be appreciated that carton engaging means 130, 132, 140 and 142 are adjustable along beams 125 and 134 to accommodate different size cartons. The carton engaging means 130, 132, 140 and 142 are respectively pivoted on pivots 130A, 132A, 140A and 142A.

The upper and lower carton engaging means 132 and 142 are shown in the retracted position whereas the upper and lower engaging means 130 and 140 are shown in the extended positions. The upper carton engaging means 140 and 142 are normally biased in the extended position by gravity. Movement of the upper beam 134 to the right in FIG. 6 causes ramp surfaces 140B and 142B to engage the upper portion of the carton to retract into the retracted position. The lower carton engaging means 130 and 132 are biased in the extended position by light tension springs 130C and 132C. Rearward movement of the beam 125 to the right in FIG. 6 enables the ramp surfaces 130B and 132B to strike the bottom portion of the carton to move into the retracted position. It should be appreciated that the simplicity of design incorporating the C-shaped vertical support 136 enables both the bottom and the top portion of the carton to be conveyed on the second track 22 with a minimum of mechanical linkage. In the prior art, various chains, sprockets and drive mechanisms had to be utilized to drive the bottom and top portions of the carton. The instant mechanism enables the same function to be accomplished with the minimum amount of mechanical linkage thus increasing reliability.

The rotatable shaft in 102 in FIG. 8 includes a sprocket 148 which drives a chain 150 connected to a sprocket 152 to rotate a shaft 154 having a plurality of cams 160–164 thereon. A plurality of switches 160A–164A provide the control to the various functions of the operation of the machine. Switch 160A controls the tucker arm assembly 44 whereas switch 161A controls the carton erecting means 32. Switch 162A controls vacuum for the vacuum pick heads 82 and left cylinders 94 for the first means 71. Switch 163A controls the cylinder of compression ram 62 whereas switch 164A is a limit switch for insuring that the unit finishes a complete cycle.

FIG. 9 is an enlarged view of the tucker arm assembly 44 comprising shoe 45 pivotably mounted on shaft 46. Shaft 46 is journalled by bearings 170 and 172 relative to a mounting plate 174. An air cylinder 176 is connected by a pivot 178 to an arm 180 extending from shaft 46. Activation of air cylinder 176 causes the rotation of shaft 46 enabling the shoe 45 to contact the flaps of the carton. Mounting slots 182 enable the tucker arm assembly 44 to be adjusted or replaced from the apparatus.

FIGS. 10 and 11 illustrate the carton erector means 32 in the deactivated and activated position respectively. The plural arms 34 and 35 rotatably mount the vacuum cup 38 relative to a support plate 36. The plural arms 34 and 35 include pivots 34A, 34B, 35A and 35B with a connecting link 37 completing a parallelogram. Accordingly, the bottom surface of vacuum cup 38 always remains horizontal irrespective of the rotational position of arms 34 and 35.

A shaft 190 is pivotally connected to a piston actuator 192 of an air cylinder 194 mounted to support plate 36. Activation of cylinder 194 into the position shown in FIG. 11 rotates the vacuum cup 38 into position to grasp the carton for erecting same. A bottom vacuum hold down head 199 is secured to the apparatus to engage the major flap 16B whereas vacuum cup 38 engages flap 16A to open the carton 12. It should be appreciated that the mounting plate 36 includes mounting slots 196 in a manner similar to the slots 182 of the tucker arm enabling rapid replacement adjustments or interchanging of the erector means with similar or other machines.

FIG. 11 illustrate the ram stage 62 comprising a ram plate 198 slidably mounted by rods 200 in bearings 202 secured to the frame of the machine. Air cylinder ram 62 moves the ram plate into engagement with stationary plate 60 to seal the major and minor flap of the carton.

The foregoing has disclosed a unique machine incorporating various improved stages which results in a more economical and more reliable machine. It should be understood that the various stages set forth herein may be incorporated on other machines of different designs or may be interchanged on the same machine. These modifications are to be construed as being incorporated within the instant invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

I claim:

1. An apparatus for erecting folded cartons having flaps, comprising in combination:

a first and a second carton track established in a substantially L-shaped configuration;

each of said first and second tracks having a first and a second end;

carton magazine means disposed adjacent said first track;

first track movement means for moving a folded carton on said first track from said carton magazine means to said second track;

carton erecting means proximate the intersection of said first and second track for erecting the folded carton;

second track movement means for moving the erected carton from said first end of said second track to said end of said second track;

flap folding means disposed adjacent said second track for folding the flaps of the carton;

sealing means proximate said second track for sealing the flaps of the erected carton into a rigid structure;

first means for driving said first track movement means in a reciprocal movement for serially moving said plurality of cartons from said first end to said second end of said first track;

second means for driving said second track movement means for serially moving said plurality of cartons from said first end to said second end of said second track;

means for synchronizing the movement along said first and second tracks;

one of said first and second track movement means including a first and a second rotatable member space relative to one another;

flexible means about said rotatable members and having a driving portion on said flexible means for generating a reciprocal movement of said driving portion relative to said track; and means cooperating with said driving portion for intermittently and sequentially moving cartons along said track upon rotation of said rotatable members.

2. An apparatus as set forth in claim 1, wherein said first means includes an air cylinder for moving vacuum pickup arms to move the cartons along said first track.

3. An apparatus as set forth in claim 1, wherein said driving portion comprises a projection extending from said flexible means.

4. An apparatus as set forth in claim 3, wherein said one of said track movement means further comprises plural parallel finger means for receiving said projection therebetween for generating said reciprocal movement from the movement of said projection.

5. An apparatus as set forth in claim 4, wherein one of said track movement means includes a substantially C-shaped member slidably mounted relative to said second carton track for simultaneously engaging the top and bottom of an erected carton.

6. An apparatus as set forth in claim 5, wherein one of said track movement means further comprises pivotably driving surfaces for engaging the carton upon forward movement of said track movement means and for disengaging the carton upon backward movement of said track movement means.

7. An apparatus as set forth in claim 1, wherein said one of said track movement means includes a first and a second sprocket means mounted on a rotatable shaft;

a first chain interconnecting said first and second sprocket means;

a projection extending from said chain; and plural parallel finger means for receiving said projection therebetween for generating said reciprocal movement from the movement of said projection.

8. An apparatus as set forth in claim 1, wherein said erecting means includes a mounting plate having a plurality of slot apertures for positioning said carton erecting means relative to said apparatus; and air cylinder means secured to said mounting plate enabling adjustment of said carton erecting means relative to said apparatus.

9. An apparatus as set forth in claim 1, wherein said flap folding means comprises a tucker arm pivotably mounted relative to a mounting plate;

air cylinder means secured to said mounting plate for rotating said tucker arm; and adjustment mounting means for mounting said mounting plate relative to the apparatus enabling replacement or adjustment thereby.

10. An apparatus as set forth in claim 1, wherein said sealer means is adjustably mounted relative to said apparatus for enabling adjustment or replacement thereby.

11. An apparatus as set forth in claim 1, wherein said first track movement means includes plural vacuum heads slidably mounted relative to said first track;

said plural vacuum heads being pivotably moved on said slidable mounting;

means for pivoting said vacuum head into engagement with the carton; and air cylinder means for moving said vacuum head along said first track to covey the carton thereby.

12. An apparatus as set forth in claim 1, wherein said flap folding means comprises first and second flap folders for respectively folding minor and major flaps of the carton.

* * * * *